US011577907B2

(12) United States Patent
Senkiw et al.

(10) Patent No.: US 11,577,907 B2
(45) Date of Patent: Feb. 14, 2023

(54) PROTECTIVE COVER FOR ROTOR AND ASSOCIATED SHIPPING APPARATUSES

(71) Applicant: General Electric Company, Schenectady, NY (US)

(72) Inventors: Brian Patrick Senkiw, Greenville, SC (US); Michael Ericson Friedman, Simpsonville, SC (US); Bryan Edward Williams, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1347 days.

(21) Appl. No.: 15/477,450

(22) Filed: Apr. 3, 2017

(65) Prior Publication Data

US 2018/0222666 A1 Aug. 9, 2018

Related U.S. Application Data

(60) Provisional application No. 62/455,218, filed on Feb. 6, 2017.

(51) Int. Cl.
*B65D 85/68* (2006.01)
*B65D 81/127* (2006.01)
(Continued)

(52) U.S. Cl.
CPC ..... *B65D 85/68* (2013.01); *B65D 31/04* (2013.01); *B65D 81/127* (2013.01); *F01D 25/24* (2013.01); *B65D 2585/6877* (2013.01)

(58) Field of Classification Search
CPC ..... F01D 25/24; B65D 81/02; B65D 81/113; B65D 85/68; B65D 2585/6882; B65D 2585/6877; B65D 81/22; B65D 81/1075
See application file for complete search history.

(56) References Cited

U.S. PATENT DOCUMENTS 1,192,343 A * 7/1916 Pelton ..... A01J 25/15 100/132
2,708,509 A * 5/1955 Gould ..... B65D 81/07 206/335

(Continued)

FOREIGN PATENT DOCUMENTS

DE 2937187 A1 4/1981
EP 1586515 A1 * 10/2005 ..... B65D 88/745
FR 2761668 A1 10/1998

OTHER PUBLICATIONS

International Search Report and Written Opinion issued in connection with corresponding PCT Application No. PCT/US2018/014790 dated May 10, 2018.

(Continued)

*Primary Examiner* — Anthony D Stashick
*Assistant Examiner* — Blaine G Neway
(74) *Attorney, Agent, or Firm* — James Pemrick; Charlotte Wilson; Hoffman Warnick LLC

(57) ABSTRACT

Protective covers for rotors are disclosed. The protective covers may include a first liner portion contacting and covering a first portion of the rotor, and a second liner portion positioned adjacent and at least partially aligned circumferentially with the first liner portion. The second liner portion may contact and cover a second portion of the rotor. The protective covers may also include an outer casing covering the first liner portion and the second liner portion.

19 Claims, 24 Drawing Sheets

(51) Int. Cl.
*F01D 25/24* (2006.01)
*B65D 30/08* (2006.01)

(56) References Cited

U.S. PATENT DOCUMENTS

| | | | | | |
|---|---|---|---|---|---|
| 2,716,709 | A * | 8/1955 | Rowe | H02K 5/04 | 310/428 |
| 2,865,500 | A * | 12/1958 | Parsons | B65D 81/051 | 206/386 |
| 3,286,864 | A * | 11/1966 | Patterson | A61J 9/008 | 215/11.5 |
| 3,401,791 | A * | 9/1968 | Stott | B65D 81/113 | 206/204 |
| 3,892,500 | A | 7/1975 | Miller et al. | | |
| 4,032,255 | A | 6/1977 | Iizuka et al. | | |
| 7,275,995 | B2 * | 10/2007 | Doll | F16P 1/02 | 464/176 |
| 7,428,968 | B2 | 9/2008 | Osborn et al. | | |
| 8,755,852 | B2 | 6/2014 | Hynecek et al. | | |
| 2002/0197147 | A1 | 12/2002 | Kawai et al. | | |
| 2012/0312707 | A1 | 12/2012 | Baten | | |
| 2016/0032745 | A1 | 2/2016 | Ahn | | |

OTHER PUBLICATIONS

EP Search Report issued in connection with corresponding EP Application No. 18747147.9 dated Oct. 20, 2020, 7 pages.

* cited by examiner

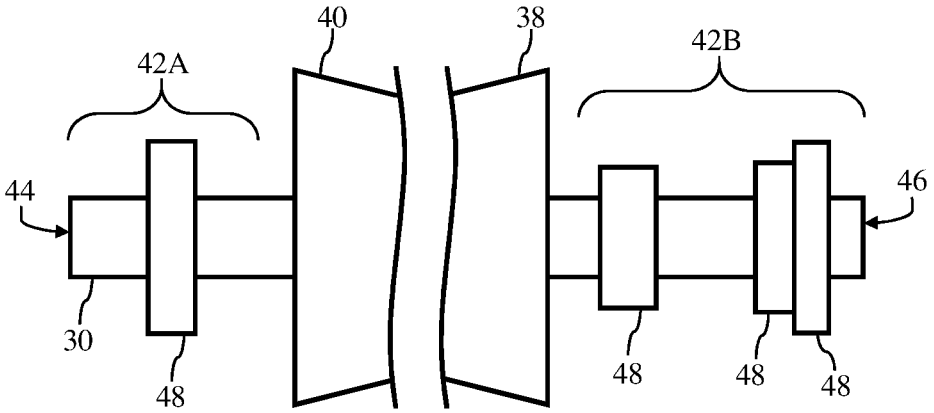
FIG. 2
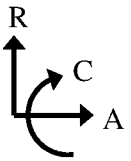

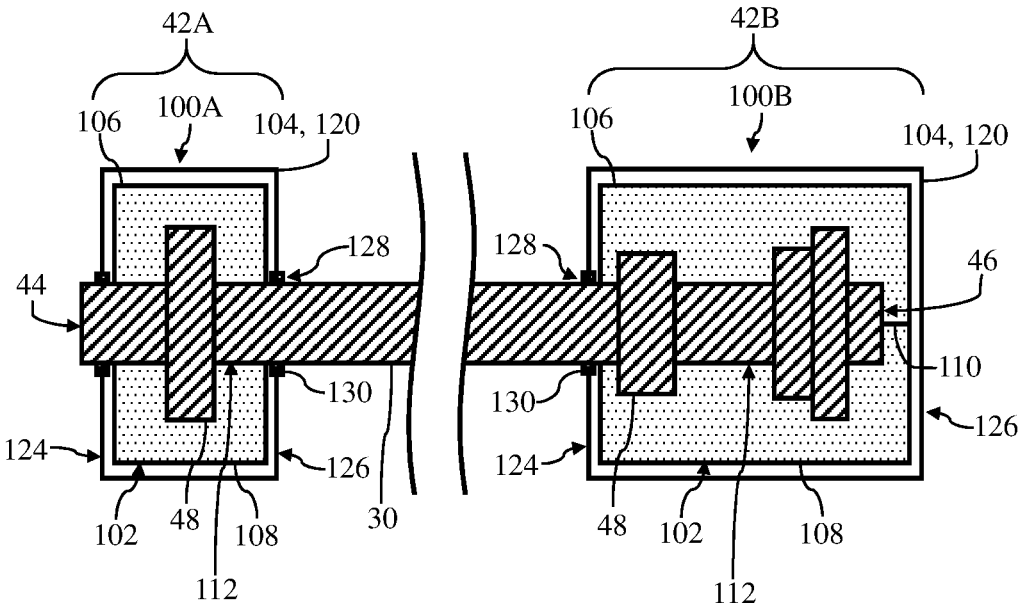
FIG. 5
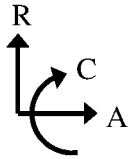

PROTECTIVE COVER FOR ROTOR AND ASSOCIATED SHIPPING APPARATUSES

CROSS-REFERENCE TO RELATED APPLICATION

This Application claims the benefit of priority to U.S. Provisional Application Ser. No. 62/455,218, filed on Feb. 6, 2017, entitled "PROTECTIVE COVER FOR ROTOR AND ASSOCIATED SHIPPING APPARATUSES," which is herein incorporated in its entirety by reference.

BACKGROUND OF THE INVENTION

The disclosure relates generally to protective covers, and more particularly, to a protective cover for a rotor of a turbine system and shipping apparatuses that utilizes the protective cover when shipping and/or transporting rotors.

Due to the dimensions and intricacies of the features included in turbine rotors, it is often difficult to safely and effectively to move or transport rotors. Whether it is removing a turbine rotor from the turbine system to perform standard maintenance procedures, or shipping a new rotor to be utilized in a turbine system, rotors and their various features or components are susceptible to undesirable contact, which may result in damage to the rotor. The damage caused by undesirable contact may result in operational inefficiencies, extra required maintenance, and in some cases, replacement of components, features or the entire rotor. Damage to the rotor and its features can be costly and time consuming for operators of turbine systems.

Conventional shipping methods utilize standard packaging material and procedures to attempt to reduce damage to the rotors during transport. For example, bearings and blade areas of a rotor are typically wrapped in various layers of plastic wrap for protection. Additionally, cardboard is often placed over these areas prior to and/or in between layers of wrapping to provide additional layers of protection. However, plastic wrap and cardboard do not provide an adequate amount of protection for the rotor; especially for portions of components like the rotor bearings, which are highly sensitive to undesirable contact. Furthermore, once the rotor reaches its destination, the only way to remove this plastic wrap and cardboard is to cut it from the rotor. As a result, even if the rotor and its components are not damaged during the transportation or shipping process, the rotor may become damaged if a person cutting away the plastic wrap and cardboard cuts too deeply and undesirably contacts or cuts the rotor.

BRIEF DESCRIPTION OF THE INVENTION

A first aspect of the disclosure provides a protective cover for a rotor. The protective cover may include: a first liner portion contacting and covering a first portion of the rotor; a second liner portion positioned adjacent and at least partially aligned circumferentially with the first liner portion, the second liner portion contacting and covering a second portion of the rotor; and an outer casing covering the first liner portion and the second liner portion.

A second aspect of the disclosure provides a shipping apparatus for a rotor. The shipping apparatus may include: a base; a plurality of supports extending from the base, the plurality of supports configured to receive and support the rotor; and a protective cover for the rotor, the protective cover coupled to the base and including: a first liner portion contacting and covering a first portion of the rotor; a second liner portion positioned adjacent and at least partially aligned circumferentially with the first liner portion, the second liner portion contacting and covering a second portion of the rotor; and an outer casing covering the first liner portion and the second liner portion.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIG. 2 shows a side view of a portion of the rotor for the gas turbine system of FIG. 1, according to embodiments.

FIGS. 5 and 6 show side cross-sectional views of the rotor of FIG. 2 and protective covers, according to embodiments.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
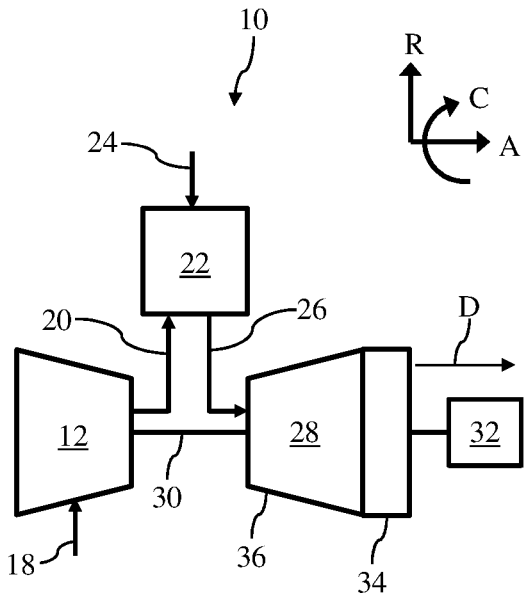
FIG. 1 shows a schematic diagram of a gas turbine system according to embodiments.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "R" (see, FIG. 1), which is substantially perpendicular with axis A and intersects axis A at only one location. Finally, the term "circumferential" refers to movement or position around axis A (e.g., axis "C").

The following disclosure relates generally to protective covers, and more particularly, to a protective cover for a rotor of a turbine system and shipping apparatuses that utilizes the protective cover when shipping and/or transporting rotors.

These and other embodiments are discussed below with reference to FIGS. 1-24. However, those skilled in the art will readily appreciate that the detailed description given herein with respect to these Figures is for descriptive purposes only and should not be construed as limiting.

FIG. 1 shows a schematic view of an illustrative gas turbine system that may include a rotor as may be protected by a cover. Gas turbine system 10 may include a compressor 12. Compressor 12 compresses an incoming flow of air 18. Compressor 12 delivers a flow of compressed air 20 to a combustor 22. Combustor 22 mixes the flow of compressed air 20 with a pressurized flow of fuel 24 and ignites the mixture to create a flow of combustion gases 26. Although only a single combustor 22 is shown, gas turbine system 10 may include any number of combustors 22. The flow of combustion gases 26 is in turn delivered to a turbine 28, which typically includes a plurality of turbine blades (see, FIG. 2) and stator vanes. The flow of combustion gases 26 drives turbine 28 to produce mechanical work. The mechanical work produced in turbine 28 drives compressor 12 via a rotor 30 extending through turbine 28, and may be used to drive an external load 32, such as an electrical generator and/or the like.

Gas turbine system 10 may also include an exhaust frame 34. As shown in FIG. 1, exhaust frame 34 may be positioned adjacent turbine 28 of gas turbine system 10. More specifically, exhaust frame 34 may be positioned adjacent to turbine 28 and may be positioned substantially downstream of turbine 28 and/or the flow of combustion gases 26 flowing from combustor 22 to turbine 28. As discussed herein, a portion (e.g., outer casing) of exhaust frame 34 may be coupled directly to an enclosure or shell 36 of turbine 28.

Subsequent to combustion gases 26 flowing through and driving turbine 28, combustion gases 26 may be exhausted, flow-through and/or discharged through exhaust frame 34 in a flow direction (D). In the non-limiting example shown in FIG. 1, combustion gases 26 may flow through exhaust frame 34 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 26 may discharge from exhaust frame 34, and may flow in the flow direction (D) into a heat recovery steam generator of the combined cycle power plant.

Turning to FIG. 2, and with continued reference to FIG. 1, a portion of rotor 30 of gas turbine system 10 is shown. As discussed herein rotor 30 may include a plurality of turbine blades 38 that may be coupled to rotor 30 and may be driven by combustion gases 26 to rotate rotor 30. Additionally as shown in FIG. 2, rotor 30 may include a plurality compressor blades 40. Compressor blades 40 may be coupled to rotor 30 and may positioned and/or housed within compressor 12 of gas turbine system 10 (see, FIG. 1). In the non-limiting example shown in FIGS. 1 and 2, as rotor 30 rotates, compressor blades 40 may also rotate to generate compressed air 20 (see, FIG. 1), while turbine blades 38 are driven by combustion gases 26 to rotate rotor 30. Not all of turbine blades 38, compressor blades 40 and/or rotor 30 are shown for clarity.

Rotor 30 may also include bearings 42A, 42B. Specifically, and as shown in FIG. 2, rotor 30 may include a single bearing 42A, 42B positioned adjacent each distal end 44, 46 of rotor 30. In a non-limiting example, first bearing 42A positioned adjacent distal end 44 may be positioned within and/or supported by compressor 12 of gas turbine system 10 (see, FIG. 1). In another non-limiting example, first bearing 42A may be positioned outside of compressor 12, opposite turbine 28 (see, FIG. 1), and may be supported by a bearing housing or support (not shown). Second bearing 42B positioned adjacent distal end 46 may be positioned within and/or supported by exhaust frame 34 of gas turbine system 10 (see, FIG. 1), or alternatively, may be supported by a bearing housing or support (not shown) positioned adjacent exhaust frame 34 (see, FIG. 1). As shown in FIG. 2, each bearing 42A, 42B may include components, elements and/or features 48 (hereafter, "features 48"). Features 48 may be coupled to, formed on and/or attached to rotor 30. Additionally, features 48 of bearings 42A, 42B may extend radially from and/or (at least partially) circumferentially around rotor 30. Features 48 of bearings 42A, 42B may be formed on rotor 30 to aid and/or improve the rotation or drive of rotor 30 during operation of gas turbine system 10 (see, FIG. 1). In non-limiting examples, features 48 of bearings 42A, 42B may include collars, oil housings or wells, and/or any other suitable feature included in bearings for rotors of turbine systems.

Figure 3:
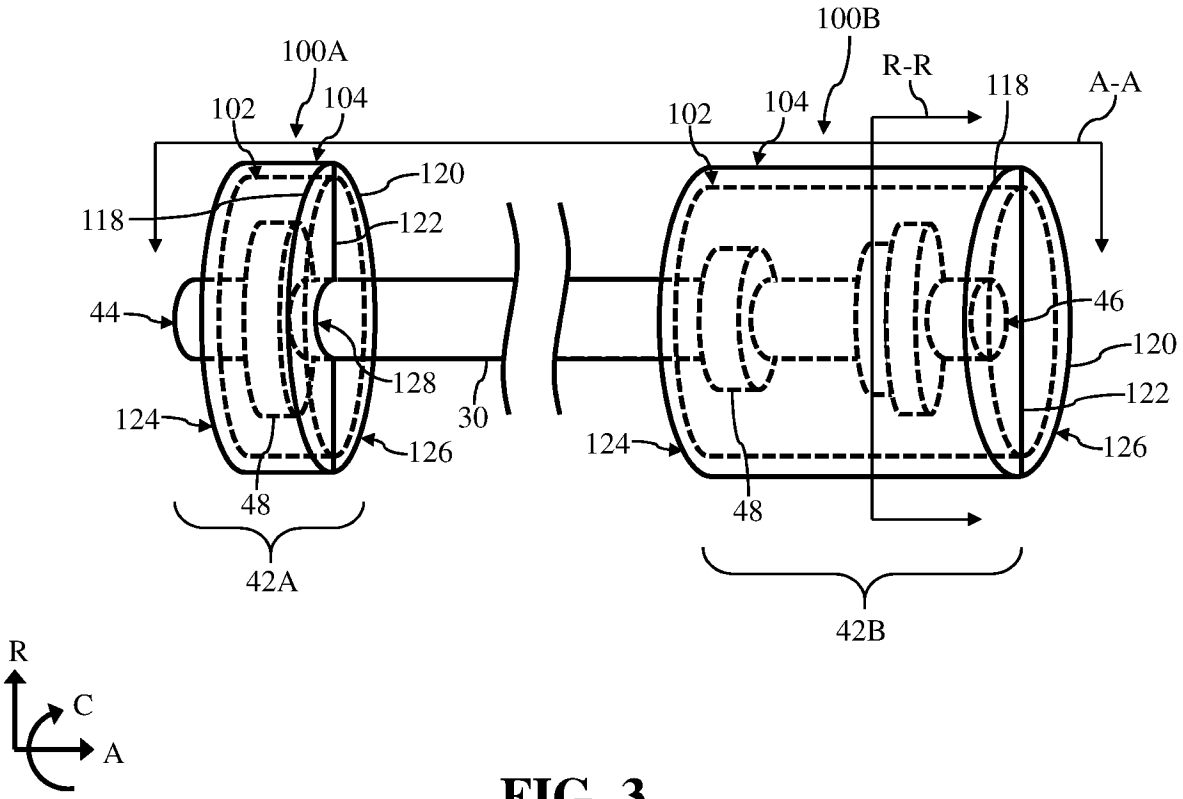
FIG. 3 shows a perspective view of the rotor of FIG. 2 and protective covers, according to embodiments.

FIG. 3 shows a perspective view of a portion of rotor 30 and protective covers 100A, 100B. Turbine blades 38 and compressor blades 40 have been removed from rotor 30 in FIG. 3 for clarity. As shown in FIG. 3, protective covers 100A, 100B may substantially cover bearings 42A, 42B (shown in phantom), respectively, of rotor 30. Specifically, protective covers 100A, 100B may substantially cover and/or protect bearings 42A, 42B and a portion of rotor 30 positioned within and/or directly adjacent to bearings 42A, 42B. As shown in FIG. 3, and discussed in detail below, protective covers 100A, 100B may be positioned on, coupled to and/or substantially surround bearings 42A, 42B and rotor 30. Rotor 30 may utilize protective covers 100A, 100B to cover, protect and/or prevent bearings 42A, 42B from being exposed when rotor 30 is being transported, moved and/or removed from gas turbine system 10, for example, to perform maintenance on rotor 30 and/or other components of gas turbine system 10. It is understood that "protective cover" and "cover" may be used interchangeably throughout this disclosure. As such, any reference to "cover 100A, 100B" may be understood or interpreted as "protective cover 100A, 100B."

Figure 4:
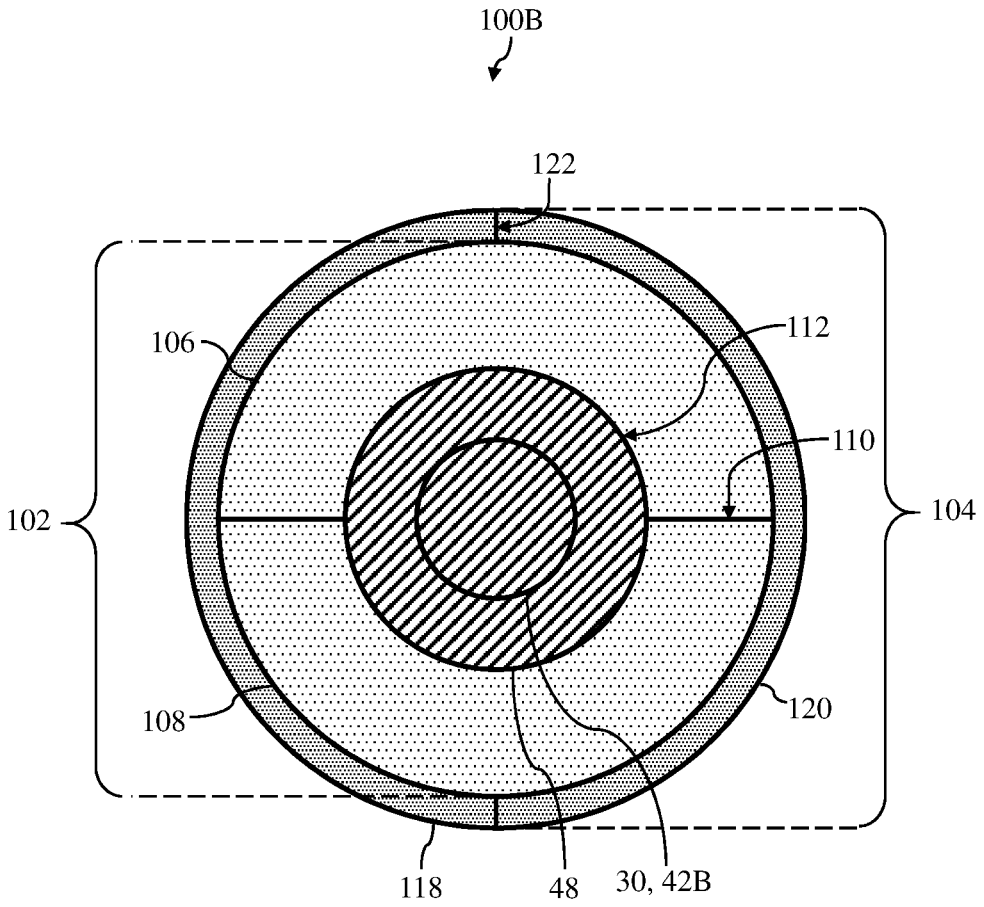
FIG. 4 shows a front cross-sectional view of the protective cover of FIG. 3, according to embodiments.
Figure 6:
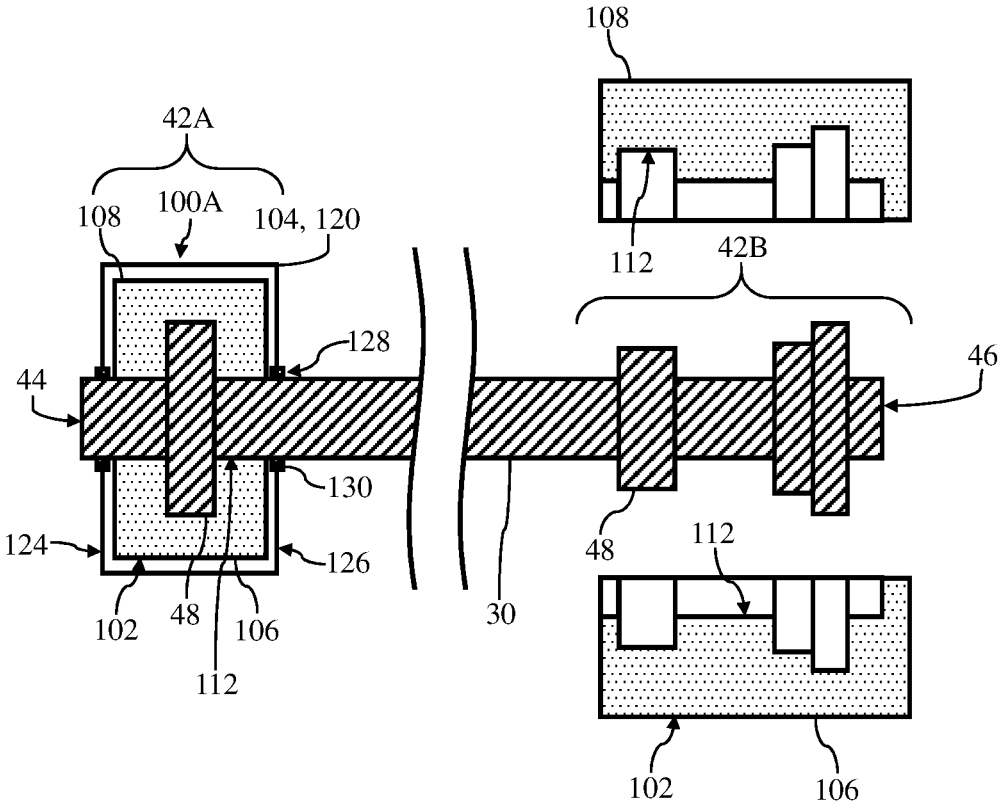

FIGS. 4-6 show various cross-sectional views of rotor 30 and protective covers 100A, 100B shown in FIG. 3. Specifically, FIG. 4 shows a cross-sectional front view of rotor 30 and protective cover 100B taken along line R-R in FIG. 3, FIG. 5 shows a cross-sectional side view of rotor 30 and protective covers 100A, 100B taken along line A-A in FIG. 3, and FIG. 6 shows a cross-sectional side view of rotor 30 and protective covers 100A, 100B taken along line A-A in FIG. 3, where a portion of protective cover 100A is exploded from rotor 30. It is understood that similarly numbered and/or named components may function in a substantially similar fashion. Redundant explanation of these components has been omitted for clarity.

With reference to FIGS. 3-6, each protective covers 100A, 100B may include a liner 102 (shown in phantom in FIG. 3) and an outer casing 104. As shown in FIGS. 3-6, liner 102 of protective covers 100A, 100B may be positioned adjacent to, axially aligned with and/or circumferentially surround bearings 42A, 42B of rotor 30. Additionally, and as discussed herein, liner 102 may contact and substantially covers bearing 42A, 42B of rotor 30 to protect and/or prevent damage to bearings 42A, 42B of rotor. Liner 102 may be coupled or fixed to outer casing 104, or alternatively, may be merely in contact (e.g., compression fit) with outer casing 104. As shown in FIGS. 3-6, outer casing 104 may substantially surround, contact and/or cover liner 102 of protective covers 100A, 100B for rotor 30. Additionally, and as discussed herein, outer casing 104 may contact and/or be (releasably) coupled to rotor 30 to secure protective cover 100A, 100B to rotor 30 and/or to cover bearings 42A, 42B. Outer casing 104 may secure liner 102 to bearings 42A, 42B and/or rotor 30 and/or may form a protective and/or rigid exterior shell around bearings 42A, 42B.

Liner 102 and/or outer casing 104 forming protective covers 100A, 100B may be formed from distinct portions. In a non-limiting example shown in FIG. 4, liner 102 may be formed from a first liner portion 106 and a second liner portion 108. As shown in FIGS. 3-6, first liner portion 106 and second liner portion 108 may be substantially aligned with each other when surrounding bearings 42A, 42B and/or rotor 30. More specifically, second liner portion 108 may be positioned adjacent to, and may be at least partially aligned circumferentially and/or axially with first liner portion 106. Additionally in the non-limiting example, first liner portion 106 may contact a first portion or area (e.g., radially upper half) of bearings 42A, 42B, features 48 and/or rotor 30, while second liner portion 108 may contact a second portion or area (e.g., radially bottom half) of bearings 42A, 42B, features 48 and/or rotor 30. The first portion of bearing bearings 42A, 42B, features 48 and/or rotor 30 may be circumferentially and/or axially aligned with the second portion of bearings 42A, 42B, features 48 and/or rotor 30. As a result of the substantial alignment of first liner portion 106 and second liner portion 108, both first and second portions of bearings 42A, 42B, features 48 and/or rotor 30 may be completely and/or collectively covered by first liner portion 106 and second liner portion 108. In another non-limiting example where features 48 of bearings 42A, 42B may not extend completely around rotor 30 (e.g., open-ring feature), first liner portion 106 and second liner portion 108 may not be completely and/or fully aligned, and only one of the liner portions 106, 108 may cover and/or contact open-ring feature 48.

As a result of liner 102 being formed from distinct, first liner portion 106 and second liner portion 108, an interface or seam 110 may be formed between first liner portion 106 and second liner portion 108 forming liner 102. In a non-limiting example shown in FIG. 4, and discussed in detail herein, first liner portion 106 and second liner portion 108 forming liner 102 may contact one another at seam 110 and may be held in place by outer casing 104. Specifically, outer casing 104 may substantially surround and/or cover first liner portion 106 and second liner portion 108 forming liner 102, and may form a compression-fit on first liner portion 106 and second liner portion 108 in order to hold or secure first liner portion 106 and second liner portion 108 to bearings 42A, 42B and/or rotor 30. In other non-limiting examples discussed herein, first liner portion 106 and second liner portion 108 may be coupled to each other at and/or adjacent seam 110 when protective covers 100A, 100B are coupled to, cover, surround and/or are utilized with rotor 30 to protect bearings 42A, 42B.

In the non-limiting example shown in FIG. 4, first liner portion 106 and second liner portion 108 may contact outer casing 104, but may not be coupled to outer casing 104. That is, where outer casing 104 forms a compression-fit on first liner portion 106 and second liner portion 108, first liner portion 106 and second liner portion 108 of liner 102 may contact and/or be contacted by outer casing 104, but may not be permanently coupled to, affixed and/or attached to outer casing 104. As a result, when outer casing 104 is removed from rotor 30, and no longer applying a compression-fit on liner 102, first liner portion 106 and second liner portion 108 of liner 102 may remain attached, coupled to and/or covering bearings 42A, 42B of rotor 30. In other non-limiting examples discussed herein, first liner portion 106 and second liner portion 108 of liner 102 may be (releasably) coupled to or permanently affixed to outer casing 104 (see, FIG. 7).

It is understood that the number of portions (e.g., first liner portion 106, second liner portion 108) used to form liner 102 is merely illustrative. Although two portions are shown and described herein to form liner 102, it is understood that more (see, FIG. 14) or less (e.g., single, unitary-body liner) (see, FIGS. 18-21) portions may be utilized to form liner 102 of protective covers 100A, 100B.

As shown in FIGS. 4-6, and specifically FIG. 6, liner 102 may include a contact surface 112 that may contact bearings 42A, 42B, features 48 and/or rotor 30. More specifically, each of first liner portion 106 and second liner portion 108 may include contact surface 112 that may touch, cover and/or contact the corresponding portion (e.g., first portion, second portion) of bearings 42A, 42B, features 48 and/or rotor 30. As shown in FIG. 6, contact surface 112 may include a geometry substantially similar to and/or corresponding to features 48 of bearings 42A, 42B and/or rotor 30. That is, contact surface 112 of first liner portion 106 may include a geometry substantially similar to and/or corresponding to at least a portion of feature(s) 48 included in the first portion of bearings 42A, 42B and/or rotor 30 that first liner portion 106 is aligned with, contacts and/or surrounds. Additionally, contact surface 112 of second liner portion 108 may include a geometry substantially similar to and/or corresponding to at least a portion of feature(s) 48 included in the second portion of bearings 42A, 42B and/or rotor 30 that second liner portion 108 is aligned with, contacts and/or surrounds. The geometry of contact surface 112 may be similar to, correspond to and/or be inverse to the shapes and/or profiles of bearings 42A, 42B, features 48 and/or rotor 30. For example, the shapes and/or profiles of bearings 42A, 42B, features 48 and/or rotor 30 may be considered the male-component, and the geometry of contact surface 112 may be consider the female-component. As such, the geometry of contact surface 112 formed in first liner portion 106 and second liner portion 108, respectively, may cover, contact and receive corresponding portions of bearings 42A, 42B, features 48 and/or rotor 30. In the non-limiting example shown in FIGS. 3-6, the geometry of contact surface 112 may be prefabricated into first liner portion 106 and second liner portion 108 forming liner 102, and may be dependent and/or specific to the shapes and/or profiles of bearings 42A, 42B, features 48 and/or rotor 30. In other non-limiting examples, the geometry of contact surface 112 may be formed and/or shaped in-place or after liner 102 contacts bearings 42A, 42B, features 48 and/or rotor 30 (see, FIGS. 18-21).

Liner 102, and specifically first liner portion 106 and second liner portion 108, may be formed from a material having malleable/deformable and/or elastic characteristics. For example, first liner portion 106 and second liner portion 106 forming liner 102 of protective covers 100A, 100B may be formed from a polymer-based material, such as rubber. However, it is understood that liner 102 of protective covers 100A, 100B may be formed from any suitable material that may cover, contact and/or protect bearings 42A, 42B, features 48 and/or rotor 30, including, but not limited to: foam, thermal plastics, textiles and the like.

Similar to liner 102, outer casing 104 may be formed of distinct sections. That is, outer casing 104 may be formed from a first section 118 and a second section 120. As shown in FIGS. 3-6, second section 120 of outer casing 104 may be positioned adjacent to, and may be aligned circumferentially and/or axially with first section 118 when surrounding liner 102. Outer casing 104 may also include an interface or seam 122 formed between first section 118 and second section 120 forming outer casing 104. In a non-limiting example shown in FIG. 4, and discussed in detail herein, first section 118 and second section 120 forming outer casing 104 may contact one another at seam 122 and may be coupled to one another to remain in place when protective cover 100A, 100B covers bearings 42A, 42B and/or rotor 30. That is, second section 120 may be releasably coupled to first section 118 of outer casing 104 maintain outer casing 104 in position when covering bearings 42A, 42B and/or rotor 30 and/or for providing a compression-fit to first liner portion 106 and second liner portion 108, as discussed herein. First section 118 and second section 120 of outer casing 104 may be releasably coupled to one another using any suitable coupling technique and/or coupling component that is discussed herein or may otherwise maintain a coupling between the sections 118, 120 to form outer casing 104 (e.g., fastener, snap-fit, ratchet, magnets and the like).

It is understood that the number of sections (e.g., first section 118, second section 120) used to form outer casing 104 is merely illustrative. Although two sections are shown and described herein to form outer casing 104, it is understood that more or less (e.g., single, unitary-body outer casing) (see, FIGS. 16 and 17) sections may be utilized to form outer casing 104 of protective covers 100A, 100B.

Each of first section 118 and second section 120 forming outer casing 104 may include endwalls 124, 126. Specifically, and as shown in FIGS. 3, 5 and 6, first section 118 and second section 120 may include corresponding portions of endwalls 124, 126 to substantially enclose protective cover 100A, 100B and/or enclose or surround liner 102. Endwalls 124, 126 of outer casing 104 may substantially surround, contact, be coupled to and/or be positioned on rotor 30 for coupling protective covers 100A, 100B, and specifically outer casing 104, to rotor 30. In the non-limiting example shown in FIGS. 3, 5 and 6, endwalls 124, 126 of outer casing 104 for protective cover 100A and endwall 124 of outer casing 104 for protective cover 100B may also include an aperture 128 formed therein. Aperture 128 may be formed in endwalls 124, 126 for outer casing 104 to receive and/or allow rotor 30 to pass through outer casing 104 to couple protective covers 100A, 100B and/or outer casing 104 to bearings 42A, 42B and/or rotor 30.

To ensure and/or improve the coupling of outer casing 104 to rotor 30, and/or to seal and substantially enclose liner 102 using outer casing 104, protective cover 100A, 100B may also include at least one sealing ring 130. Sealing rings 130 may be positioned within or may be positioned adjacent apertures 128 formed through endwalls 124, 126 of outer casing 104, and may also be positioned around, contact and/or coupled to rotor 30. As shown in FIGS. 5 and 6, sealing rings 130 may be configured to seal outer casing 104 and enclose liner 102, such that there is no access to bearings 42A, 42B, features 48 and/or rotor 30 covered and/or protected by protective covers 100A, 100B.

In another non-limiting example, endwalls 124, 126 of outer casing 104 may be substantially solid, continuous and/or may not include aperture 128. As shown in the FIGS. 3, 5 and 6, endwall 126 of outer casing 104 for protective cover 100B may be substantially solid, continuous and/or may not include aperture 128. As such the corresponding portions of endwall 126 for each of first section 118 and second section 120 of protective cover 100B may also be substantially solid, continuous and/or may not include aperture 128, and may only be separated by seam 122. In this non-limiting example, and as specifically shown in FIG. 5, protective cover 100B, including liner 102 and outer casing 104, may substantially encompass and/or completely surround distal end 46 of rotor 30, such that distal end 46 is not exposed when protective cover 100B covers, surrounds and/or protects bearing 42B and/or rotor 30, as discussed herein.

Outer casing 104, and specifically first section 118 and second section 120, may be formed from a material having substantially rigid characteristics. For example, first section 118 and second section 120 forming outer casing 104 of protective covers 100A, 100B may be formed from metal, metal alloys, or polymers (e.g., plastic). However, it is understood that outer casing 104 of protective covers 100A, 100B may be formed from any suitable material that may cover, contact and/or protect bearings 42A, 42B, features 48 and/or rotor 30, including, but not limited to, ceramics, wood, and the like.

Figure 7:
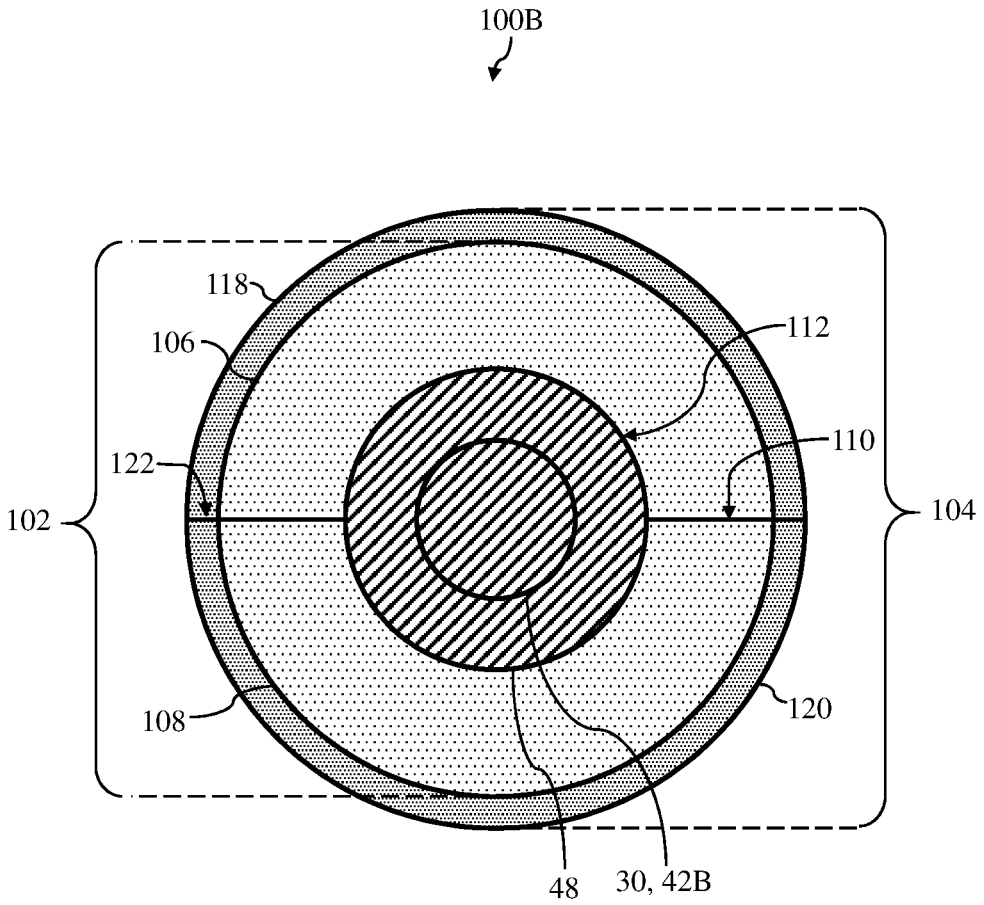
FIG. 7 shows a front cross-sectional view of a protective cover, according to additional embodiments.

FIG. 7 shows another, non-limiting front cross-sectional view of a portion of rotor 30 and protective cover 100B. As shown in FIG. 7, and distinct from FIG. 4, seam 110 of liner 102, and seam 122 of outer casing 104 may be radially aligned. As a result, first liner portion 106 of liner 102 may be radially aligned with first section 118 of outer casing 104, and second liner portion 108 of liner 102 may be radially aligned with second section 120 of outer casing 104. Additionally in the non-limiting example shown in FIG. 7, liner 102, and its respective portions, may be coupled to outer casing 104, and its respective, aligned sections. Specifically, first liner portion 106 of liner 102 may be coupled to first section 118 of outer casing 104, and second liner portion 108 of liner 102 may be coupled to second section 120 of outer casing 104. In non-limiting example, first liner portion 106 of liner 102 may be releasably coupled to first section 118 of outer casing 104, and second liner portion 108 of liner 102 may be releasably coupled to second section 120 of outer casing 104 using any suitable coupling technique and/or coupling component that is discussed herein or may otherwise maintain a coupling liner 102 and outer casing 104. Where liner portions 106, 108 of liner 102 are releasably coupled to corresponding sections 118, 120 of outer casing 104, liner portions 106, 108 of liner 102 may be removed from bearings 42A, 42B and/or rotor 30 when sections 118, 120 of outer casing 104 are uncoupled from bearings 42A, 42B and/or rotor 30. Alternatively, liner portions 106, 108 of liner 102 releasably coupled to corresponding sections 118, 120 of outer casing 104, may remain in contact and/or cover bearings 42A, 42B and/or rotor 30 when sections 118, 120 of outer casing 104 are uncoupled from bearings 42A, 42B and/or rotor 30.

In another non-limiting example shown in FIG. 7, liner 102, and its respective portions, may be permanently affixed to outer casing 104, and its respective, aligned sections. Specifically, first liner portion 106 of liner 102 may be permanently affixed to first section 118 of outer casing 104, and second liner portion 108 of liner 102 may be permanently affixed to second section 120 of outer casing 104. In non-limiting example, first liner portion 106 of liner 102 may be permanently affixed to first section 118 of outer casing 104, and second liner portion 108 of liner 102 may be permanently affixed to second section 120 of outer casing 104 using any suitable component joining technique and/or joining component that is discussed herein or may otherwise affix liner 102 to outer casing 104 (e.g., adhesive, melting, welding, soldering and so on). Where liner portions 106, 108 of liner 102 are permanently affixed to corresponding sections 118, 120 of outer casing 104, liner portions 106, 108 of liner 102 may be removed from bearings 42A, 42B and/or rotor 30 when sections 118, 120 of outer casing 104 are uncoupled from bearings 42A, 42B and/or rotor 30. For example, when first section 118 of outer casing 104 is uncoupled from bearings 42A, 42B and/or rotor 30, first liner portion 106 may be removed with first section 118 and may no longer contact and/or cover the first portion of bearings 42A, 42B, features 48 and/or rotor 30, as discussed herein.

FIGS. 8-13 show various non-limiting examples of first liner portion 106 coupled to second liner portion 108 to form liner 102 of protective cover 100A, 100B. It is understood that similarly numbered and/or named components may function in a substantially similar fashion. Redundant explanation of these components has been omitted for clarity.

Figure 8:
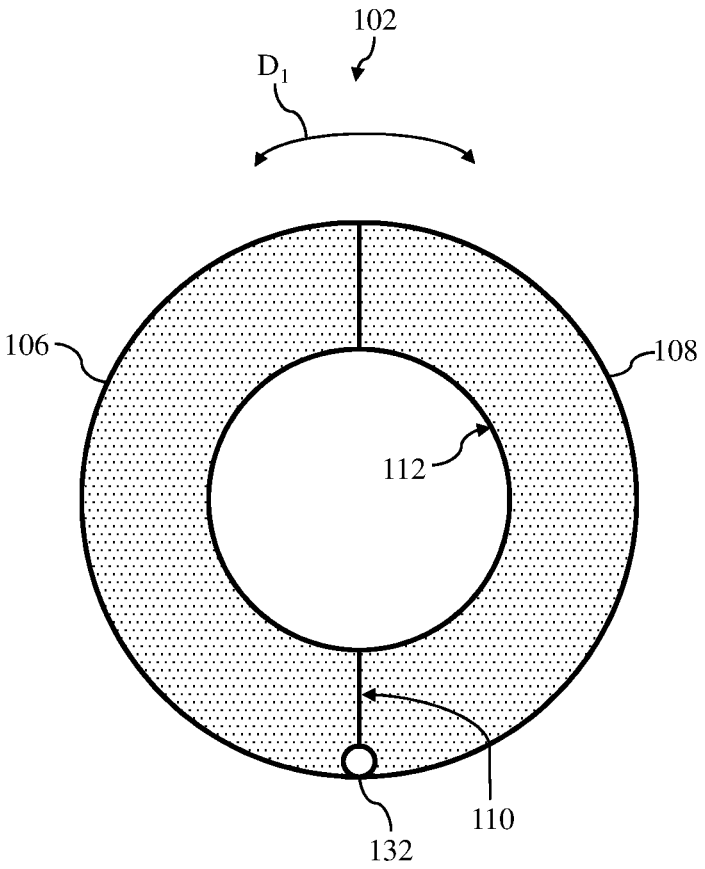
FIGS. 8 and 9 show front cross-sectional views of a pivotally coupled liner of a protective cover, according to embodiments.
Figure 9:
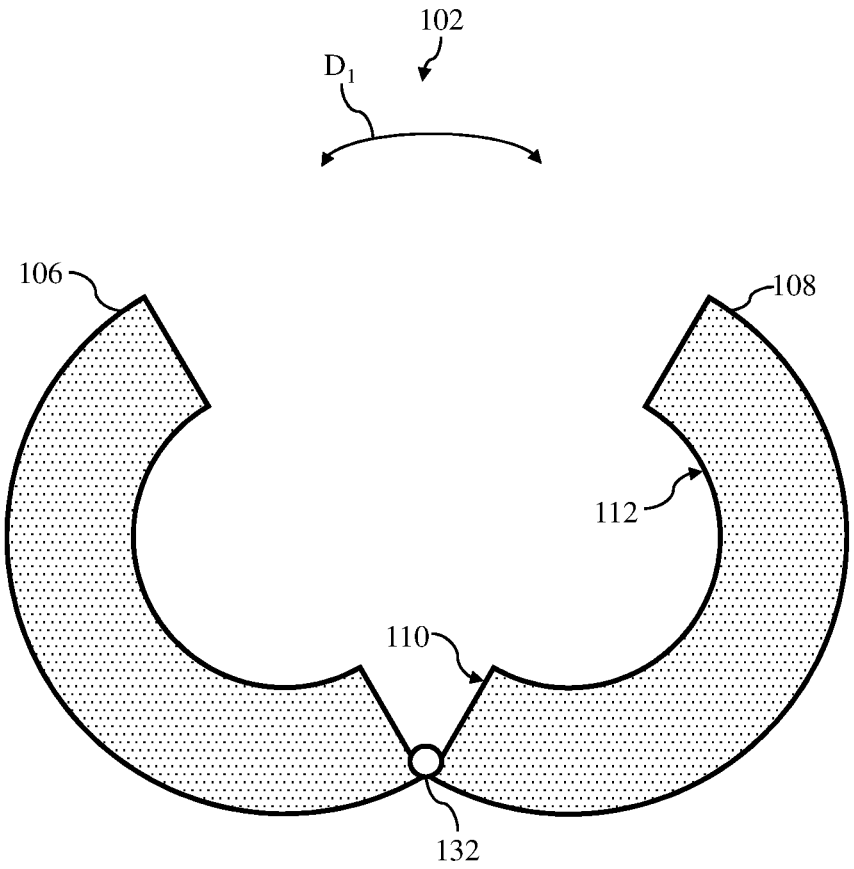

As shown in FIGS. 8 and 9, first liner portion 106 may be pivotally coupled to second liner portion 108. Specifically, seam 110 formed between first liner portion 106 and second liner portion 108 may include a pivot coupling or joint 132 (hereafter, "pivot joint 132") that may be coupled to first liner portion 106 and second liner portion 108, respectively. As a result of being pivotally coupled, first liner portion 106 and/or second liner portion 108 may be configured to move and/or rotate about pivot joint 132 in a direction ($D_1$) to open liner 102. During a coupling or installation process for liner 102 and/or protective cover 100A, 100B, liner 102 may be opened by moving and/or rotating first liner portion 106 and/or second liner portion 108 about pivot joint 132 in a direction ($D_1$) to place liner 102 around bearings 42A, 42B, features 48 and/or rotor 30. Pivot joint 132 may ensure first liner portion 106 and/or second liner portion 108 may be separated and/or opened wide enough to clear bearings 42A, 42B and/or rotor 30 during the installation process and/or avoid undesirable and/or unnecessary contact between liner 102 and rotor 30.

Figure 10:
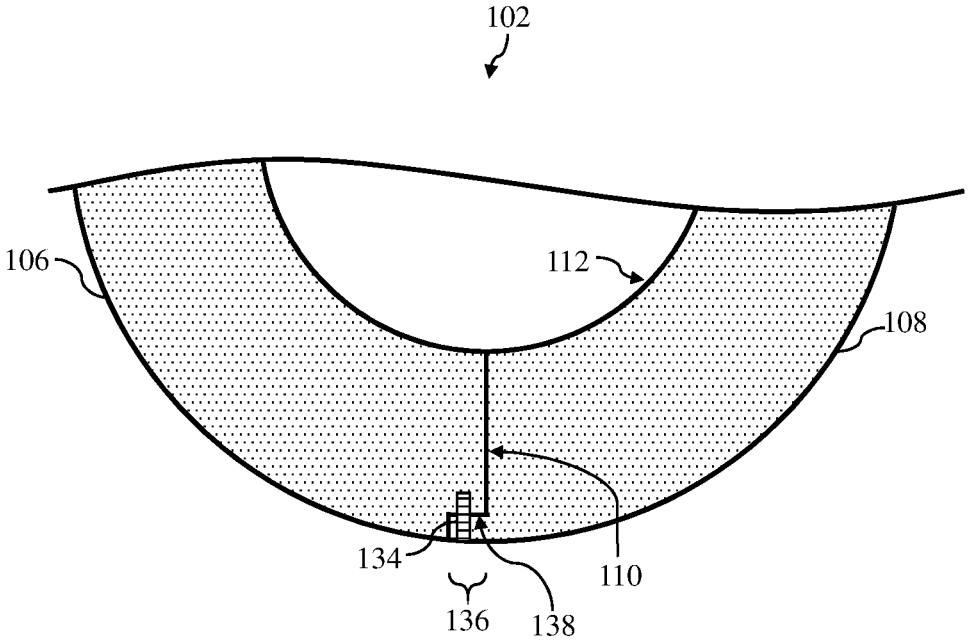
FIG. 10 shows a front cross-sectional view of a portion of a liner of a protective cover including a fastener, according to embodiments.
Figure 11:
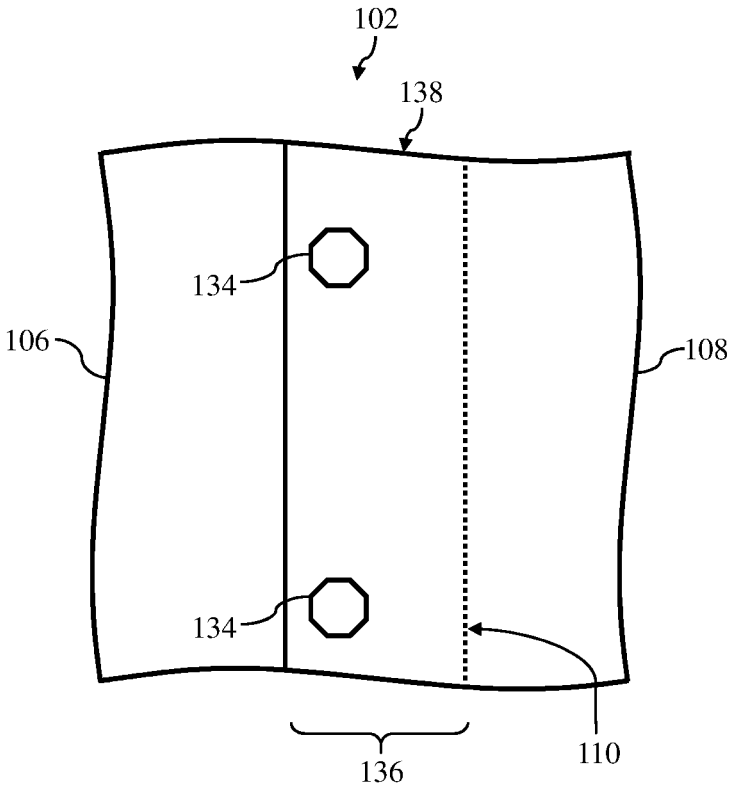
FIG. 11 shows a top view of the portion of the liner of the protective cover including the fastener of FIG. 10, according to embodiments.

FIGS. 10 and 11 show first liner portion 106 releasably coupled to second liner portion 108 via a fastener 134. Specifically, FIG. 10 shows a front cross-sectional view of a portion of first liner portion 106 releasably coupled to second liner portion 108 via fastener 134, and FIG. 11 shows a bottom view of a portion of first liner portion 106 releasably coupled to second liner portion 108 via fasteners 134. As shown in FIGS. 10 and 11, second liner portion 108 may include a protrusion or tab 136 (hereafter, "tab 136") that may extend into and/or be seated into a recess 138 formed in first liner portion 106. In a non-limiting example, tab 136 and recess 138 may be formed and/or span over the axial length of first liner portion 106 and second liner portion 108, respectively. In another non-limiting example, second liner portion 108 may include a plurality of tabs 136, and first liner portion 106 may include corresponding recesses 138 for the plurality of tabs 136 that may be circumferentially aligned and configured to receive tabs 136, as discussed herein. Tab 136 of second liner portion 108 and a portion of first liner portion 106 radially aligned with tab 136 may receive fastener 134 for coupling and/or joining first liner portion 106 and second liner portion 108. As shown in FIG. 11, first liner portion 106 and second liner portion 108 may be coupled to form liner 102 using a plurality of fasteners 134 (two shown) that may be spread out axially over first liner portion 106 and second liner portion 108. Although shown as a threaded bolt, fastener 134 may be any suitable fastening or coupling component that may be utilized to releasably couple first liner portion 106 to second liner portion 108. Although only shown on one side, end, surface and/or adjacent a portion of seam 110 of liner 102, it is understood that another fastener 134, tab 136 and recess 138 configuration may be included in a portion of liner 102 formed opposite the portion shown in FIG. 10.

Figure 12:
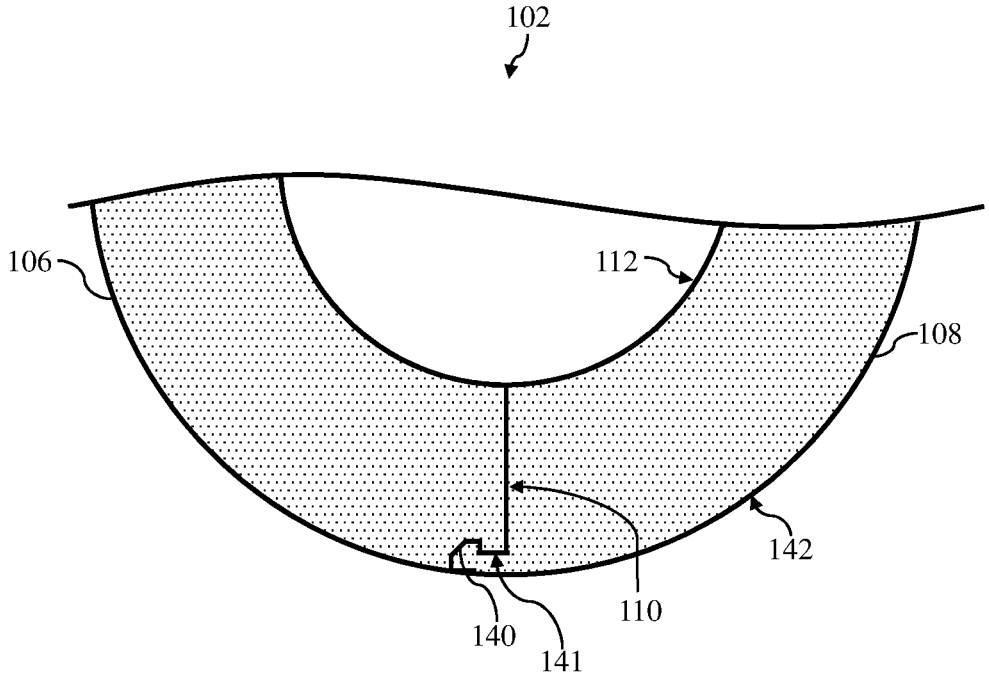
FIG. 12 shows a front cross-sectional view of a portion of a liner of a protective cover including a snap-fit, according to embodiments.
Figure 13:
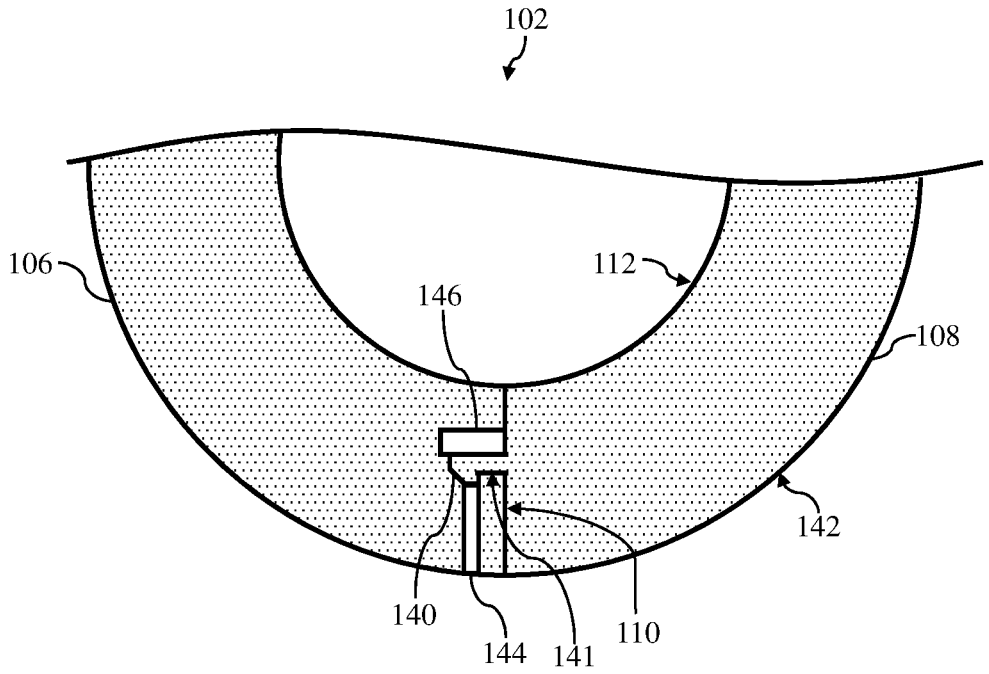
FIG. 13 shows a front cross-sectional view of a portion of a liner of a protective cover including a snap-fit, according to additional embodiments.

FIGS. 12 and 13 show front cross-sectional views of a portion of first liner portion 106 releasably coupled to second liner portion 108 via a cantilever snap-fit 140. Specifically, second liner portion 108 includes cantilever snap-fit 140 that extends into, contacts and/or is retained by a latch or slot 141 formed in first liner portion 106 to couple second liner portion 108 to first liner portion 106. In the non-limiting example shown in FIG. 12, cantilever snap-fit 140 may be formed directly adjacent and/or may be exposed on an exterior surface 142 of liner 102. As a result, cantilever snap-fit 140 may be engaged/disengaged for coupling/uncoupling first liner portion 106 and second liner portion 108 by manipulating and/or deflecting cantilever snap-fit 140 at exterior surface 142 of liner 102.

In the non-limiting example shown in FIG. 13, cantilever snap-fit 140 may be positioned and/or formed within second liner portion 108. Specifically, cantilever snap-fit 140 may be formed within second liner portion 108 between contact surface 112 and exterior surface 142 of liner 102. Similar to the non-limiting example shown in FIG. 12, cantilever snap-fit 140 formed in second liner portion 108 between contact surface 112 and exterior surface 142 may extend into, contact and/or may be retained by a latch or slot 141 formed in first liner portion 106. However, distinct from the non-limiting example shown in FIG. 12, first liner portion 106 may include additional features where cantilever snap-fit 140 may be formed in second liner portion 108 between contact surface 112 and exterior surface 142. As shown in FIG. 13, first liner portion 106 may include a through hole 144 formed through first liner portion 106 extending to and/or providing access to cantilever snap-fit 140. Through hole 144 may allow access to cantilever snap-fit 140 to ensure that cantilever snap-fit 140 is engaged for coupling first liner portion 106 and second liner portion 108. Additionally, through hole 144 formed in first liner portion 106 may provide access to cantilever snap-fit 140 to deflect and/or bend cantilever snap-fit 140 to disengage and/or uncouple second liner portion 108 from first liner portion 106. First liner portion 106 may also include a recess 146 radially aligned with cantilever snap-fit 140 and configured to receive and/or allow cantilever snap-fit 140 to be deflected and/or bend into recess 146 when engaging or disengaging cantilever snap-fit 140, as discussed herein.

Figure 14:
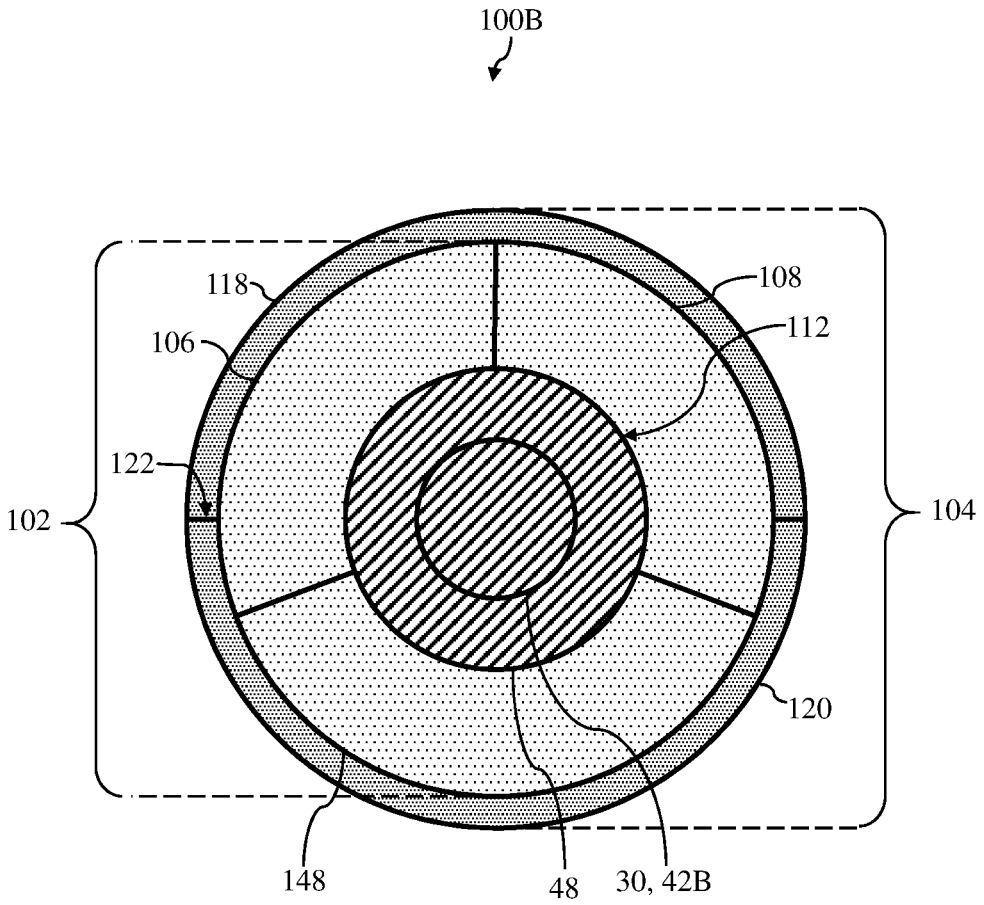
FIG. 14 shows a front cross-sectional view of a protective cover, according to further embodiments.

FIG. 14 shows a front cross-sectional view of protective cover 100B. In the non-limiting example shown in FIG. 14, liner 102 of protective cover 100B may be formed from three, distinct liner portions. Specifically, liner 102 may include and/or be formed from first liner portion 106, second liner portion 108 and third liner portion 148. Third liner portion 148 may be positioned between and at least partially aligned, circumferentially and/or axially, with first liner portion 106 and/or second liner portion 108. Similar to first liner portion 106 and second liner portion 108, third liner portion 148 may contact and/or cover a third portion of bearings 42A, 42B, features 48 and/or rotor 30. Additionally, third liner portion 148 may also include contact surface 112 that may include a geometry that may be similar and/or correspond to a shape and/or profile of third portion of bearings 42A, 42B, features 48 and/or rotor 30, as similarly discussed herein with respect to contact surfaces 112 of first liner portion 106 and/or second liner portion 108.

Figure 15:
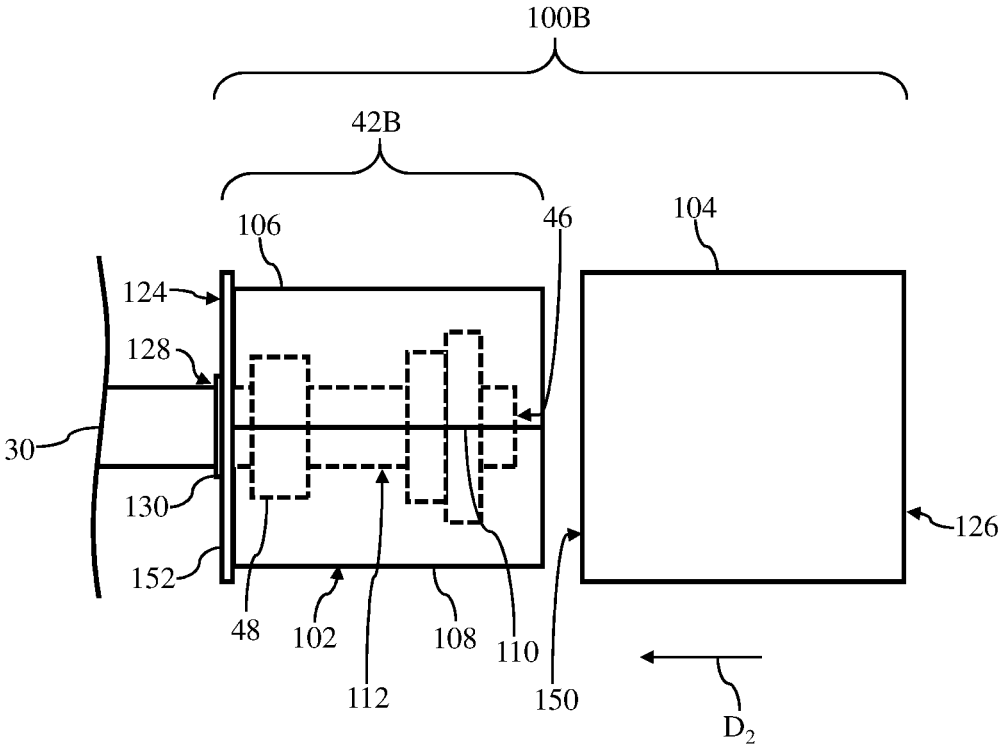
FIGS. 15 and 16 show side views of a portion of a rotor and a protective cover including a unibody outer casing, according to embodiments.
Figure 16:
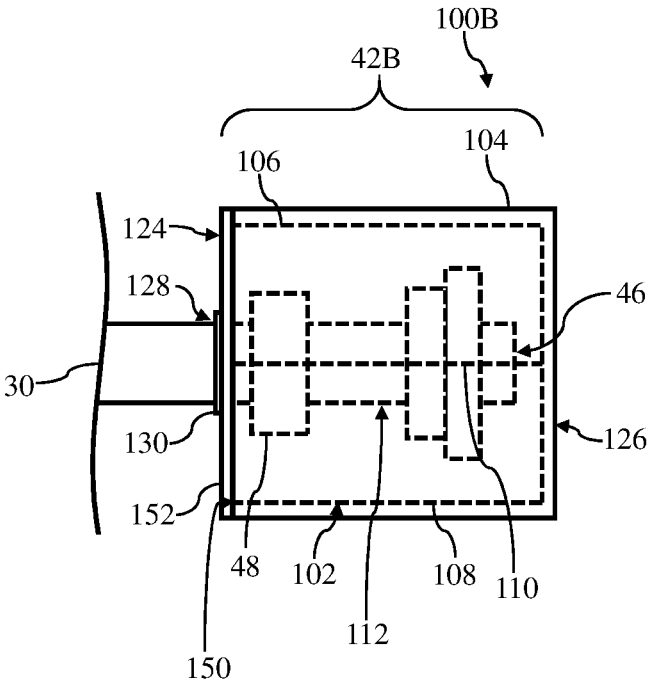

FIGS. 15 and 16 show a side view of a portion of rotor 30 and protective cover 100B. Distinct from protective covers previously discussed herein, protective cover 100B shown in FIGS. 15 and 16 may include outer casing 104 substantially formed as a single, unibody. More specifically, outer casing 104 may not be formed from distinct sections that are separated and/or joined a seam (see, FIGS. 3-6), but rather, outer casing 104 shown in FIGS. 15 and 16 may include a single, substantially solid unibody that may be positioned over and/or slidingly engage liner 102 to form protective cover 100B. As shown in FIG. 15, unibody outer casing 104 may include an opening 150 formed opposite endwall 126. Opening 150 may be configured to receive liner 102 and/or allow unibody outer casing 104 to move in a direction ($D_2$) (see, FIG. 15) to substantially cover and/or slidingly engage liner 102 and any liner portions (e.g., first liner portion 106, second liner portion 108) forming liner 102. Additionally, and as discussed herein, unibody outer casing 104 may form a compression-fit on liner 102 to hold or secure liner 102 to bearings 42A, 42B and/or rotor 30. Similar to outer casing 104 of protective cover 100B shown and discussed herein with respect to FIGS. 3-6, endwall 126 of unibody outer casing 104 may be solid and/or continuous, and may be configured to cover and/or encompass distal end 46 of shaft 30.

In the non-limiting example shown in FIGS. 15 and 16, protective cover 100B, and specifically unibody outer casing 104, may also include an end plate 152. Similar to endwalls 124, 126 discussed herein, end plate 152 may be utilized to substantially enclose protective cover 100A and/or enclose or surround liner 102. End plate 152 may be releasably coupled to unibody outer casing 104, and may substantially surround, contact, be coupled to and/or be positioned on rotor 30. Also similar to endwalls 124, 126 discussed herein, end plate 152 may be formed as two distinct sections or halves and may include aperture 128 formed therein for receiving and/or allowing rotor 30 to pass through end plate 152 to couple protective covers 100B and/or unibody outer casing 104 to bearings 42A, 42B and/or rotor 30. As shown in FIGS. 15 and 16, sealing ring 130 may be positioned within or may be positioned adjacent aperture 128 formed through end plate 152, and may also be positioned around, contact and/or coupled to rotor 30. As similarly discussed herein with respect to FIGS. 5 and 6, sealing ring 130 may be configured to seal outer casing 104 and enclose liner 102, such that there is no access to bearing 42B, features 48 and/or rotor 30 covered and/or protected by protective covers 100B.

Figure 17:
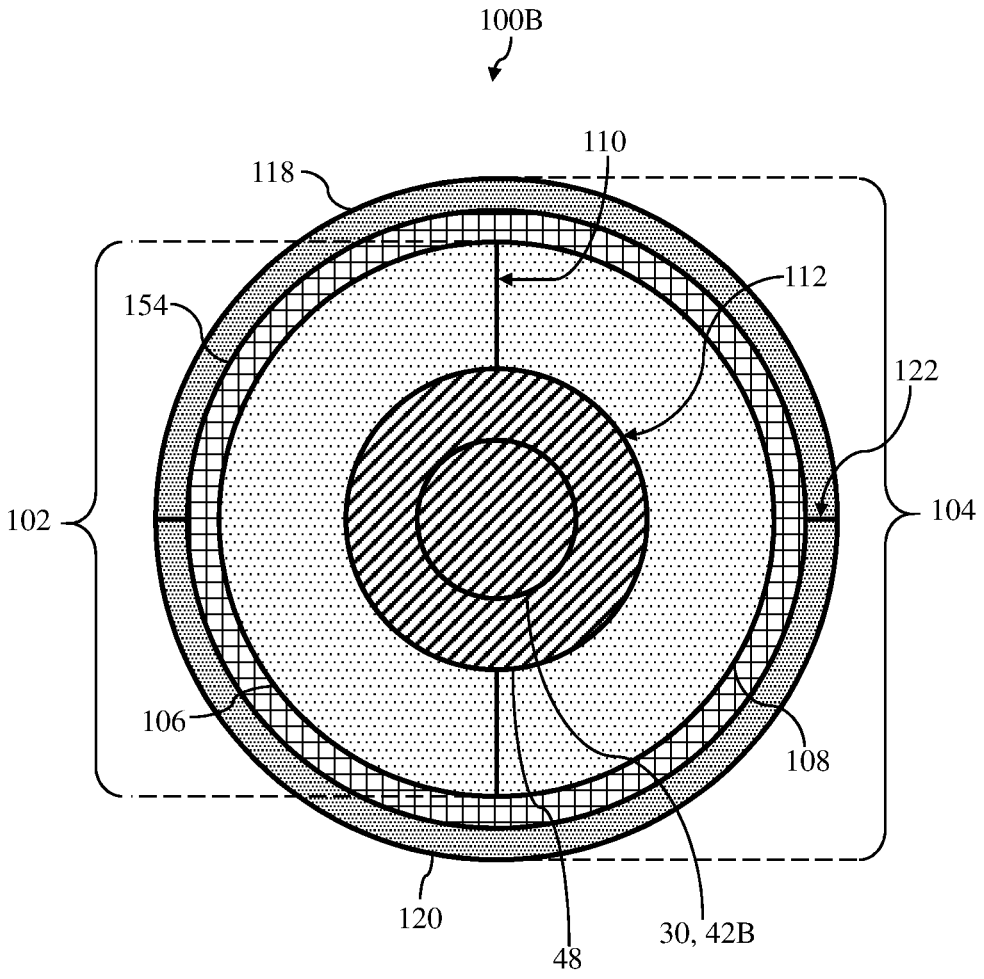
FIG. 17 shows a front cross-sectional view of a protective cover including a sleeve, according to embodiments.

FIG. 17 shows a front cross-sectional view of protective cover 100B. In the non-limiting example shown in FIG. 17, protective cover 100B may also include a sleeve 154. Sleeve 154 may surround first liner portion 106 and second liner portion 108 forming liner 102. Additionally, sleeve 154 may be positioned and/or formed between liner 102 and outer casing 104. That is, outer casing 104 may substantially cover and/or contact sleeve 154 surrounding liner 102. In a non-limiting example shown in FIG. 17, sleeve 154 may be formed as a solid, continuous, unibody with two openings (not shown) formed on opposite ends. In the non-limiting example, sleeve 154 may slidingly engage and/or form a compression-fit around first liner portion 106 and second liner portion 108, similar to that of unibody outer casing 104 discussed herein with respect to FIGS. 15 and 16. Sleeve 154 may be formed from any suitable material that may be capable of being slid over liner 102 and/or form a compression-fit around liner 102. In non-limiting examples, sleeve 154 may be formed from foam, polymers including rubber, plastic and the like. In another non-limiting example, sleeve 154 may include an adjustable diameter, such that after sleeve 154 is slid over and/or circumferentially/axially aligned with liner 102, the diameter of sleeve 154 may be adjusted so sleeve 154 may contact and/or form a compression-fit around liner 102.

Figure 18:
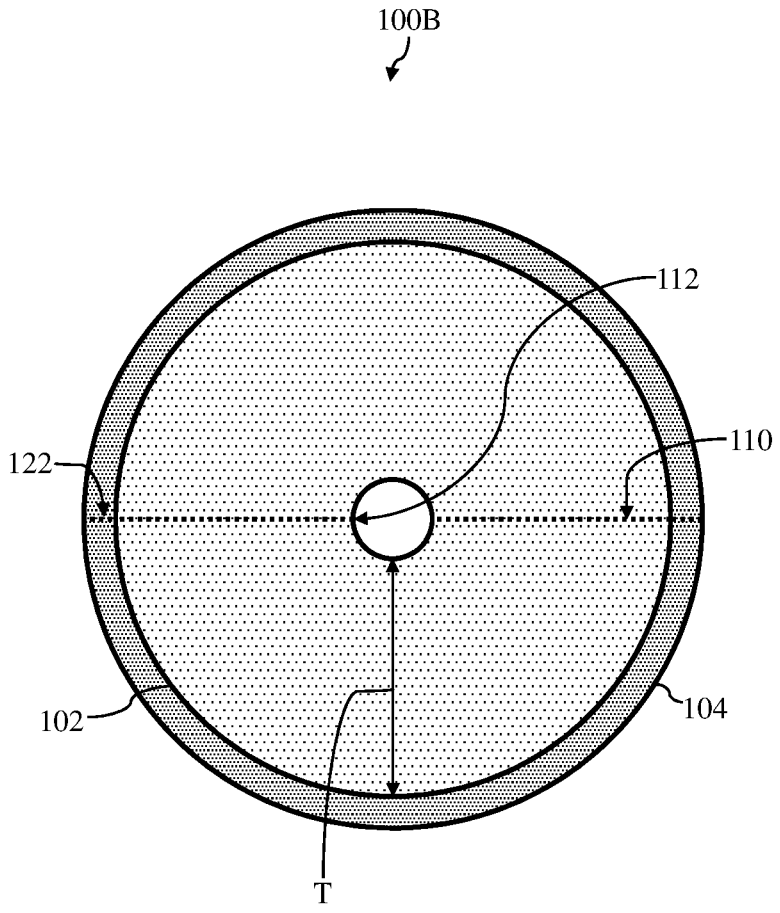
FIG. 18 shows a front cross-sectional view of a protective cover including a deformable, uniform liner, according to embodiments.
Figure 19:
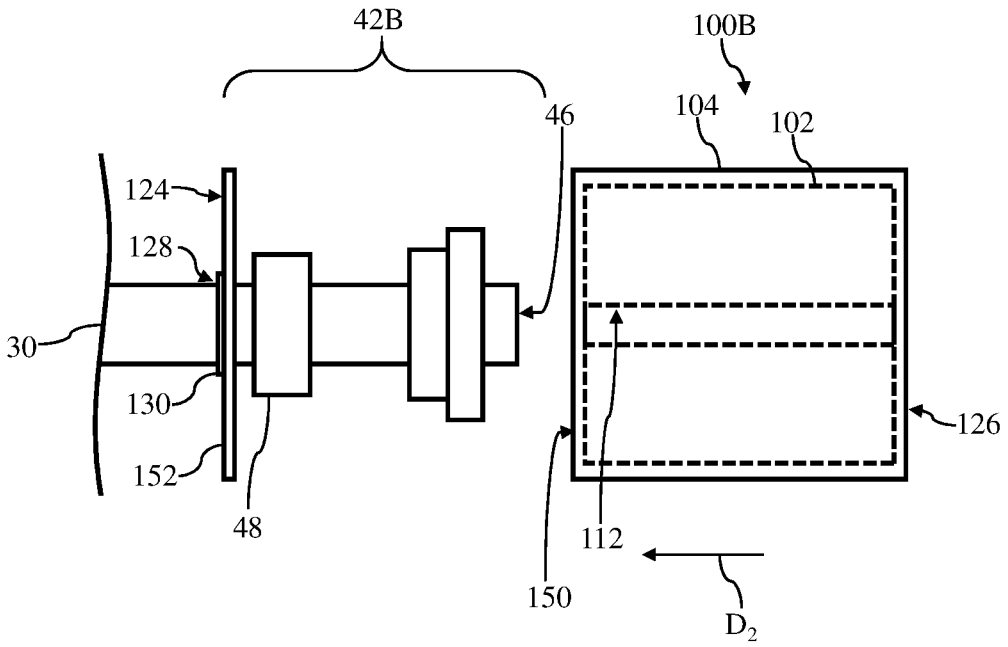
FIGS. 19-21 show side views of a portion of a rotor and the protective cover including the deformable, uniform liner of FIG. 18, according to embodiments.
Figure 20:
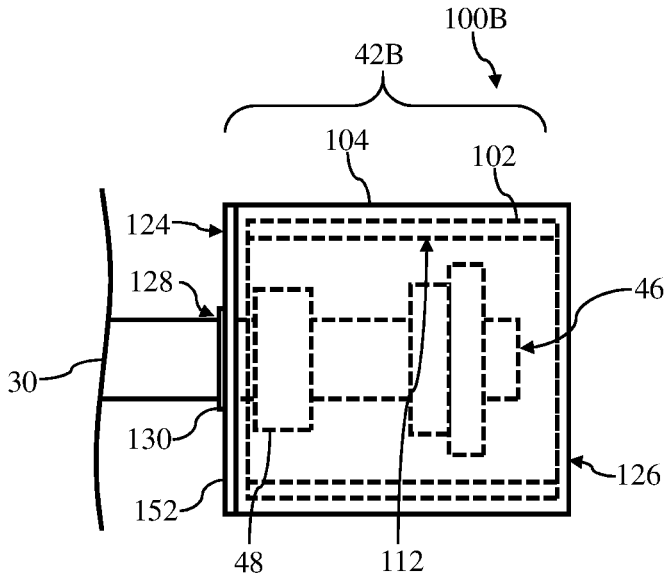
Figure 21:
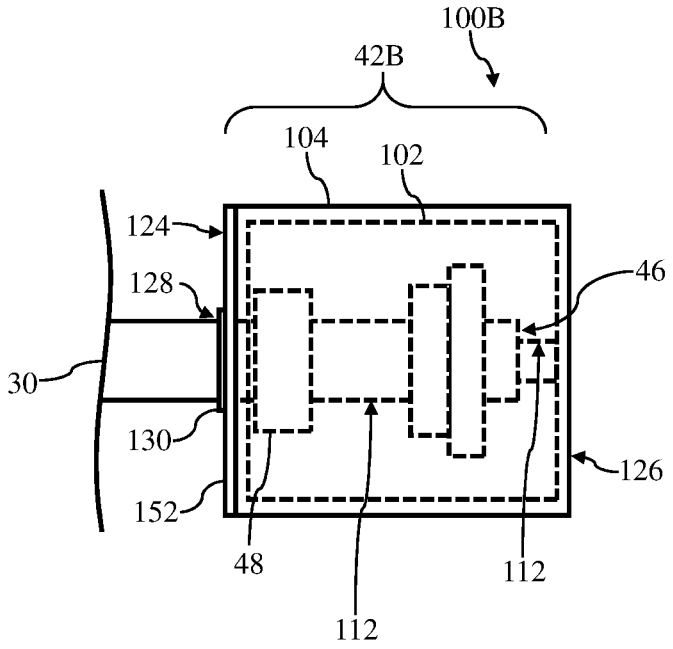

FIGS. 18-21 show another, non-limiting example of protective cover 100B. Specifically, FIG. 18 shows a front cross-sectional view of protective cover 100B including a deformable, uniform liner 102, and FIGS. 19-21 show a side view of a portion of rotor 30 and protective cover 100B including deformable uniform liner 102. Turning to FIGS. 18 and 19, and with comparison to liner 102 discussed herein with respect to FIGS. 3-6, deformable, uniform liner 102 of protective cover 100B may include a uniform thickness (T) over the axial length of liner 102. Additionally, contact surface 112 of deformable, uniform liner 102 may be substantially uniform, planar, and/or may not initially include any geometries similar to bearing 42B, features 48 and/or rotor 30 (see, FIG. 19), as discussed herein. As shown in FIG. 18, deformable, uniform liner 102, as well as outer casing 104, may be formed as a single, unibody liner for protective cover 100B. Alternatively, and shown in phantom in FIG. 18, deformable, uniform liner 102 and/or outer casing 104 of protective cover 100B may be formed from various portions and/or sections, as similarly discussed herein.

As shown in FIGS. 18 and 19, deformable, uniform liner 102 may not initially (e.g., before contacting bearing 42B and/or rotor 30) include a geometry that may be similar to the shape and/or profile of bearing 42B, features 48 and/or rotor 30, as discussed herein. Rather, deformable, uniform liner 102 may conform and/or take the shape or profile of bearing 42B, features 48 and/or rotor 30 after being positioned around and/or aligned with bearing 42B, features 48 and/or rotor 30. That is, deformable, uniform liner 102 may be formed from a material that may include malleable, deformable and/or compressible characteristics, as well as, elastic characteristics, such that deformable, uniform liner 102 may take, conform and/or match the shapes and/or profiles of bearing 42B, features 48 and/or rotor 30 after being positioned around the same. As shown in FIG. 20, deformable, uniform liner 102 may be compressed to allow deformable, uniform liner 102 and/or outer casing 104 to move over and/or surround bearing 42B, features 48 and/or rotor 30. Additionally, deformable, uniform liner 102 may be compressed to avoid undesirable contact with bearing 42B, features 48 and/or rotor 30. Once outer casing 104 and deformable, uniform liner 102 are aligned with and/or substantially surround bearing 42B, features 48 and/or rotor 30, deformable, uniform liner 102 may begin to return to its original, uniform and/or planar geometry based on liner's 102 elastic characteristics. However, because deformable, uniform liner 102 includes malleable characteristics, and because the profile of bearing 42B, features 48 and/or rotor 30 is dimensionally (e.g., diameter) larger than the diameter of the space or opening formed through liner 102, liner 102 may cover, contact and/or substantially contour to the profile of bearing 42B, features 48 and/or rotor 30 (see, FIG. 21). In a non-limiting example, deformable, uniform liner 102 of protective cover 100B shown in FIGS. 18-21 may be formed from foam.

Figure 22:
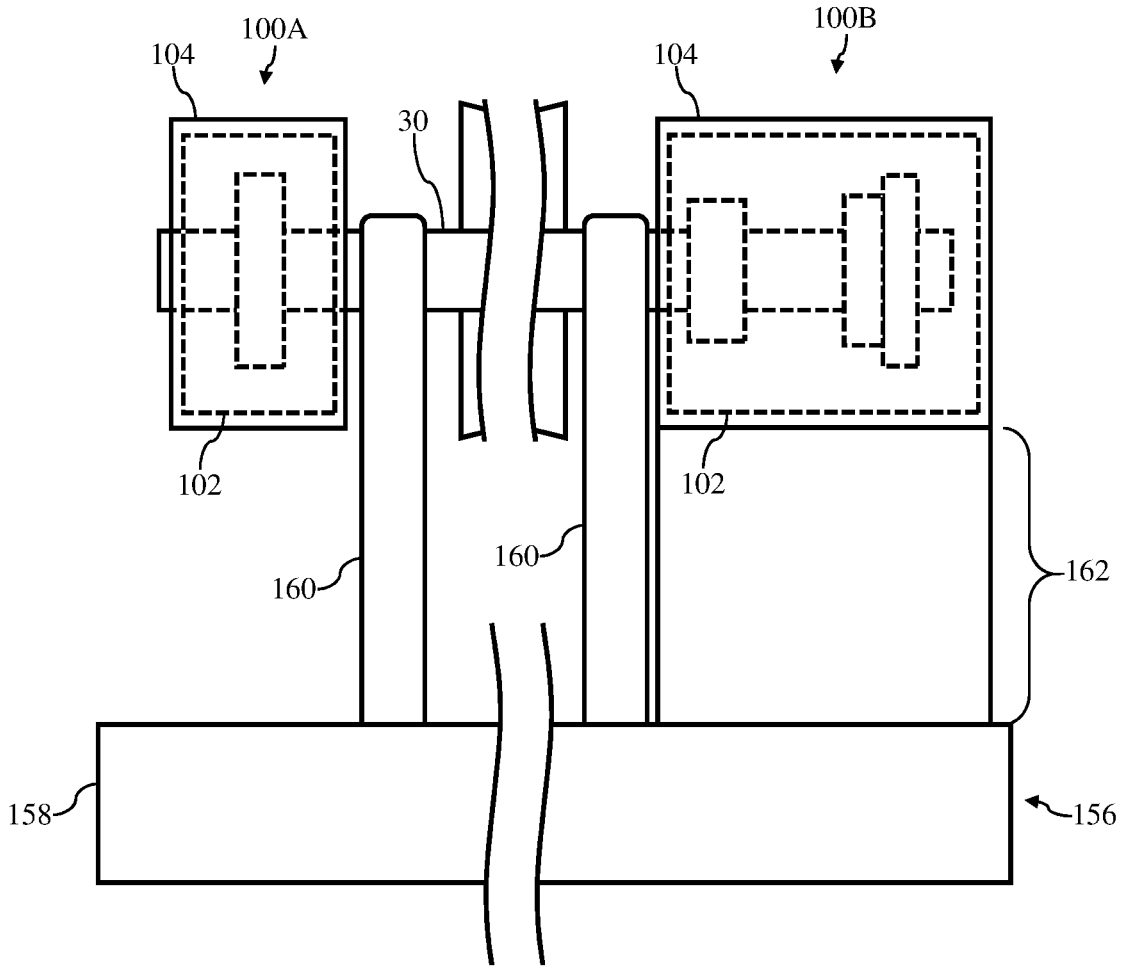
FIGS. 22-24 show side views of a portion of a rotor, protective covers and a shipping apparatus, according to various embodiments.
Figure 23:
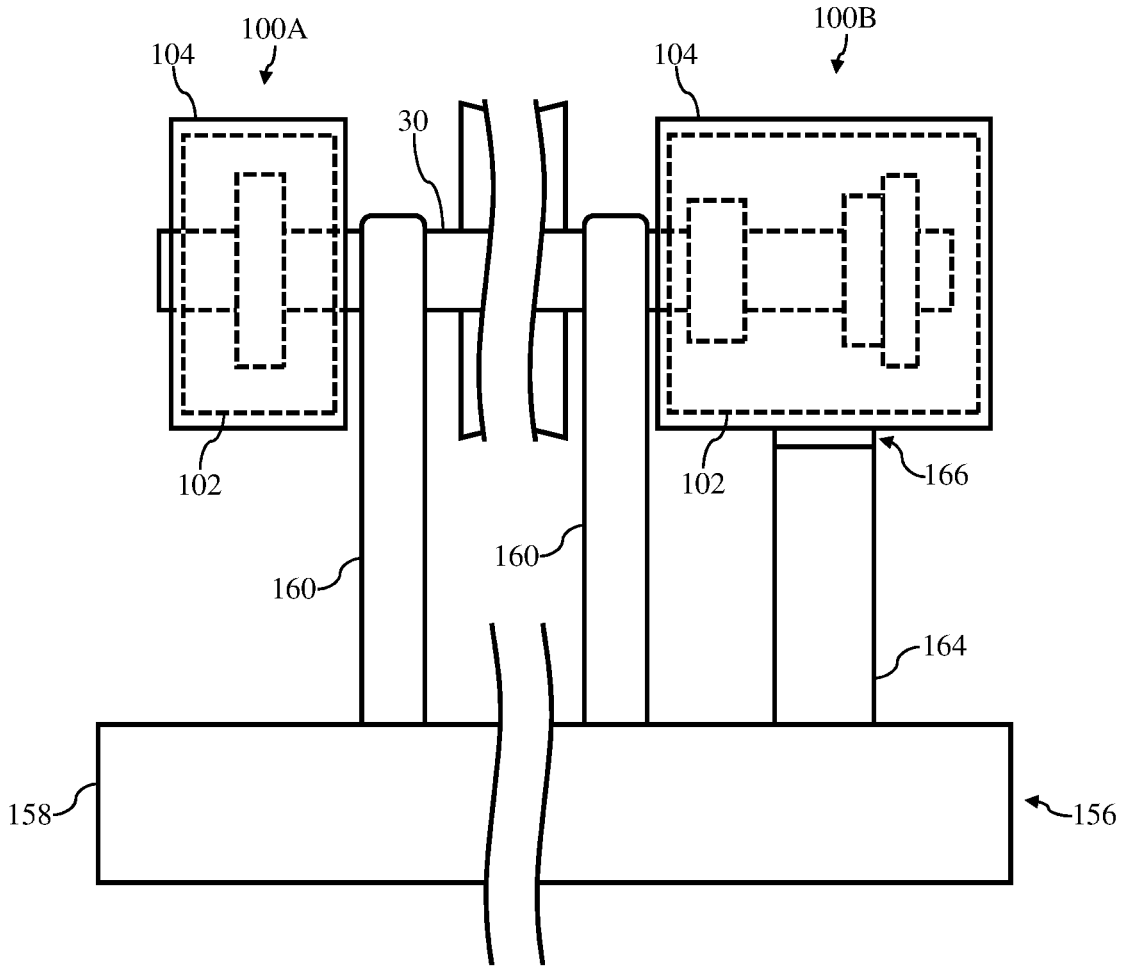
Figure 24:
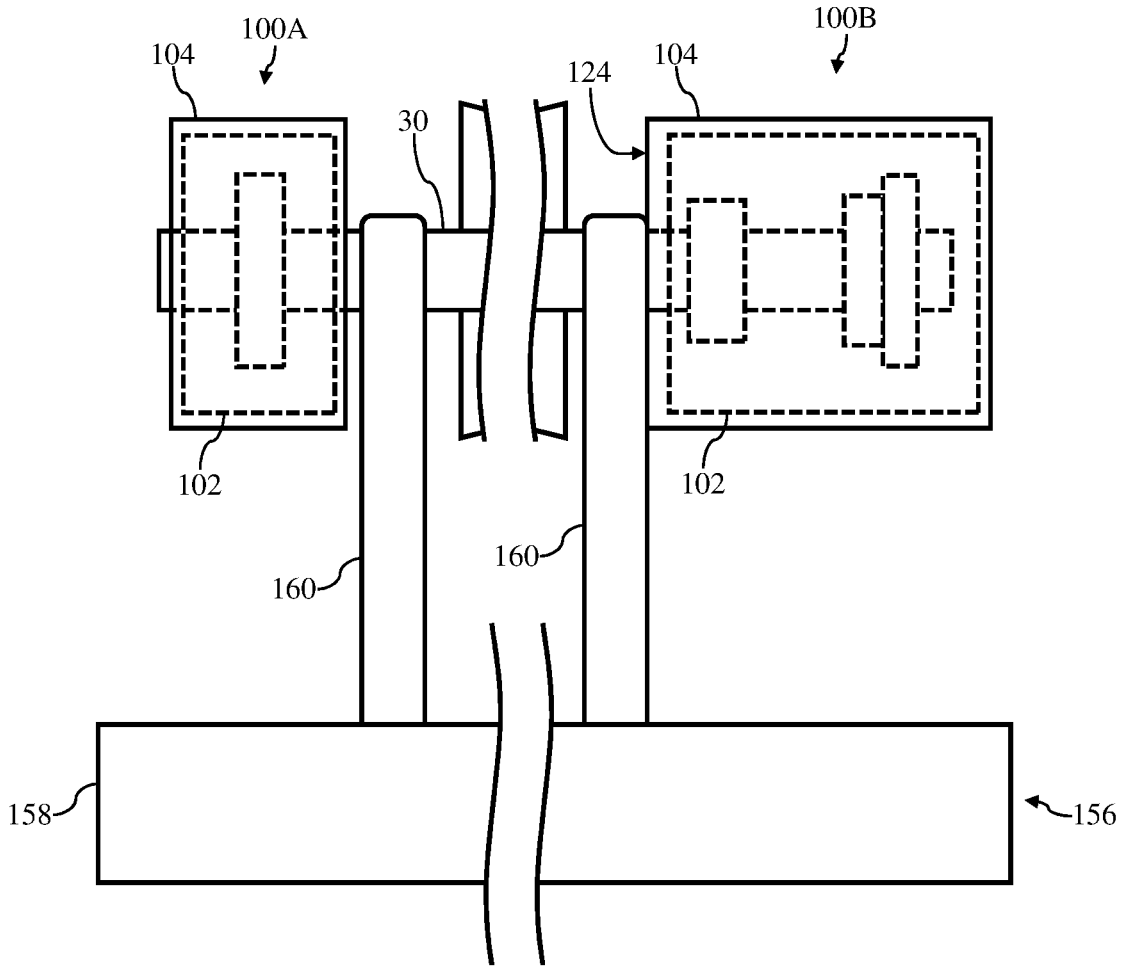

FIGS. 22-24 show various, non-limiting examples of a shipping apparatus for rotor 30. As shown in FIGS. 22-24, and discussed herein, shipping apparatus 156 may be utilized to ship rotor 30 and may utilize protective covers 100A, 100B to protect bearings 42A, 42B and/or rotor 30 during the shipping process. It is understood that similarly numbered and/or named components may function in a substantially similar fashion. Redundant explanation of these components has been omitted for clarity.

As shown in FIGS. 22-24, shipping apparatus 156 may include a base 158, and a plurality of supports 160 extending from base 158. Specifically, the plurality of supports 160 may extend upwards from and/or away from base 158. The plurality of supports 160 of shipping apparatus 156 may be configured to receive and/or support rotor 30. In the in non-limiting examples shown in FIGS. 22-24 rotor 30 may be supported by, may be coupled to and/or may rest on the plurality of supports 160 of shipping apparatus 156. Each of the plurality of supports 160 of shipping apparatus 156 may contact and/or receive rotor 30 adjacent to protective covers 100A, 100B surrounding, covering and/or protecting bearings 42A, 42B and/or rotor 30. That is, the plurality of supports 160 may not overlap with and/or receive any portion of protective covers 100A, 100B.

In the non-limiting examples shown in FIGS. 22-24, protective cover 100B may be coupled to shipping apparatus 156. That is, protective cover 100B may be coupled or affixed, directly or indirectly, to base 158 or support 160 of shipping apparatus 156. Protective cover 100B may be coupled or affixed to shipping apparatus 156 so protective cover 100B may be reused by shipping apparatus 156 when shipping various, distinct rotors 30 that may utilize protective cover 100B.

In the non-limiting example shown in FIG. 22, outer casing 104 of protective cover 100B may include an extended segment 162 that may extend toward and contact or be coupled to base 158 of shipping apparatus 156. Extended segment 162 may be a portion of outer casing 104, but may act as a coupling and/or support for outer casing 104 of protective cover 100B by extending between and being coupled to base 158 of shipping apparatus 156. In a non-limiting example, extended segment 162 may be coupled to base 158 and may be formed integral with a section (e.g., second section 120; see, FIG. 7) of outer casing 104 that may be substantially aligned with and/or surround a bottom portion (e.g., radial bottom half) of bearing 42B and/or rotor 30. In other non-limiting example, extended segment 162 of outer casing 104 may be releasably coupled to or pivotally coupled to base 158 of shipping apparatus 156. Extended segment 162 may be releasably coupled to or pivotally coupled to base 158 of shipping apparatus 156 to aid in the removal of protective cover 100B, and/or its various component (e.g., outer casing 104, liner 102) from rotor 30.

In the non-limiting example shown in FIG. 23, shipping apparatus 156 may include a strut 164 positioned between base 158 and outer casing 104 of protective cover 100B. Specifically, strut 164 may be positioned between and may be coupled or affixed to base 158 of shipping apparatus 156 and outer casing 104 of protective cover 100B, respectively. In non-limiting examples, strut 164 may be releasably coupled to or pivotally coupled to outer casing 104 of protective cover 100B at interface 166. Outer casing 104 of protective cover 100B may be releasably coupled to or pivotally coupled to strut 164 of shipping apparatus 156 at interface 166 to aid in the removal of protective cover 100B, and/or its various component (e.g., outer casing 104, liner 102) from rotor 30. Additionally, outer casing 104 of protective cover 100B may be releasably coupled to or pivotally coupled to strut 164 at interface 166 to aid in the removal of rotor 30 from portions of protective cover 100B that may not be uncoupled from shipping apparatus 156 and/or strut 164.

In a non-limiting example shown in FIG. 24, protective cover 100B may be coupled directly to support 160 of shipping apparatus 156. Specifically, at least a portion of endwall 124 of outer casing 104 of protective cover 100B may be coupled or affixed to support 160 of shipping apparatus 156. As similarly discussed herein, endwall 124 of outer casing 104 may be releasably coupled to or pivotally coupled to support 160 of shipping apparatus 156 to aid in the removal of protective cover 100B from rotor 30, and/or aid in the removal of rotor 30 from protective cover 100B.

Although only protective cover 100B is shown to be coupled to shipping apparatus 156, it is understood that protective cover 100A may be coupled to shipping apparatus 156 in any similar fashion or manner discussed herein with respect to protective cover 100B.

Although discussed herein as being aligned with and substantially covering protecting bearings of a rotor, it is understood that the protective covers discussed herein may be utilized to cover, contact and/or protect any portion of the rotor during a shipping process. That is, any portion of a rotor for a turbine system may utilize the protective covers discussed herein to prevent undesired contact and/or damage to portions of the rotor during moving, removal and/or shipping processes. For example, the protective covers discussed herein may be utilized to protect compressor blades and/or turbine blades that may be coupled to the rotor. Additionally, it is understood that protective covers may be used in other applications, other than rotors for gas turbine systems. That is, protective covers may be utilized by any rotor of a mechanical system, or may be used to protect any substantially linear component or device during shipping and/or transportation process.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A protective shipping cover for a rotor, the protective cover comprising:
   - a first liner portion contacting and covering a first portion of the rotor;
   - a second liner portion positioned adjacent and at least partially aligned circumferentially with the first liner portion, the second liner portion contacting and covering a second portion of the rotor; and
   - an outer casing covering the first liner portion and the second liner portion, wherein at least one of the first liner portion and the second liner portion includes a contact surface having a prefabricated geometry substantially similar to at least a portion of a feature included on the rotor, wherein the outer casing slidingly engages and forms a compression-fit around the first liner portion and the second liner portion.

2. The protective cover of claim 1, wherein the first liner portion is releasably coupled to the second liner portion.

3. The protective cover of claim 1, wherein the first liner portion is pivotally coupled to the second liner portion.

4. The protective cover of claim 1, wherein the first liner portion includes a contact surface having a prefabricated geometry substantially similar to at least a portion of a feature included on the first portion of the rotor.

5. The protective cover of claim 1, wherein the second liner portion includes a contact surface having a prefabricated geometry substantially similar to at least a portion of a feature included on the second portion of the rotor.

6. The protective cover of claim 1, further comprising a third liner portion positioned between and at least partially aligned circumferentially with the first liner portion and the second liner portion, the third liner portion contacting and covering a third portion of the rotor.

7. The protective cover of claim 1, wherein the first liner portion and the second liner portion are formed from a material having at least one of malleable characteristics, or elastic characteristics.

8. The protective cover of claim 1, wherein:
   - the first liner portion is coupled to the outer casing; and
   - the second liner portion is coupled to the outer casing.

9. The protective cover of claim 1, wherein the outer casing includes:
   - a first section; and
   - a second section releasably coupled to the first section.

10. The protective cover of claim 1, further comprising a sleeve substantially surrounding the first liner portion and the second liner portion, the sleeve configured to slidingly engage and form a compression-fit around the first liner portion and the second liner portion.

11. The protective cover of claim 10, wherein the outer casing covers and contacts the sleeve substantially surrounding the first liner portion and the second liner portion.

12. The protective cover of claim 1, further comprising at least one sealing ring positioned adjacent an endwall of the outer casing, the sealing ring contacting the rotor and configured to substantially seal the outer casing.

13. A protective shipping apparatus for a rotor, the shipping apparatus comprising:
   - a base;
   - a plurality of supports extending from the base, the plurality of supports configured to receive and support the rotor; and
   - a protective shipping cover for the rotor, the shipping protective cover coupled to the base and including:
     - a first liner portion contacting and covering a first portion of the rotor;

a second liner portion positioned adjacent and at least partially aligned circumferentially with the first liner portion, the second liner portion contacting and covering a second portion of the rotor; and an outer casing covering the first liner portion and the second liner portion, wherein at least one of the first liner portion and the second liner portion includes a contact surface having a prefabricated geometry substantially similar to at least a portion of a feature included on the rotor, wherein the outer casing slidingly engages and forms a compression-fit around the first liner portion and the second liner portion.

14. The shipping apparatus of claim 13, wherein the outer casing of the protective cover is one of releasably coupled or pivotally coupled to the base.

15. The shipping apparatus of claim 13, further comprising a strut positioned between the base and the outer casing of the protective cover.

16. The shipping apparatus of claim 15, wherein the outer casing of the protective cover is one of releasably coupled or pivotally coupled to the strut.

17. The shipping apparatus of claim 13, wherein the first liner portion of the protective cover is one of releasably coupled to or pivotally coupled to the second liner portion of the protective cover.

18. The shipping apparatus of claim 13, wherein the first liner portion of the protective cover includes a contact surface directly contacting the first portion of the rotor, the contact surface of the first liner prefabricated to be configured to substantially contour to at least one feature included on the first portion of the rotor.

19. The shipping apparatus of claim 13, wherein the second liner portion of the protective cover includes a contact surface directly contacting the second portion of the rotor, the contact surface of the second liner prefabricated to be configured to substantially contour to at least one feature included on the second portion of the rotor.

* * * * *